US005162808A

United States Patent [19]

Kim

[11] Patent Number: 5,162,808

[45] Date of Patent: Nov. 10, 1992

[54] ANTENNA FEED WITH SELECTABLE RELATIVE POLARIZATION

[75] Inventor: Chang S. Kim, Hickory, N.C.

[73] Assignee: Prodelin Corporation, Conover, N.C.

[21] Appl. No.: 629,575

[22] Filed: Dec. 18, 1990

[51] Int. Cl.[5] ..... H01Q 13/00; H01Q 19/00

[52] U.S. Cl. ..... 343/786; 343/756

[58] Field of Search ..... 343/786, 776, 756, 840; 333/21 A, 126, 135, 21 R

[56] References Cited

U.S. PATENT DOCUMENTS

| | | | |
|---|---|---|---|
| 2,975,380 | 9/1957 | Scharfman . | |
| 3,668,567 | 6/1972 | Rosen . | |
| 3,922,621 | 11/1975 | Gruner . | |
| 3,924,205 | 12/1975 | Hansen et al. . | |
| 4,222,017 | 9/1980 | Foldes | 333/21 A |
| 4,311,973 | 1/1982 | Nuding et al. | 333/21 A |
| 4,353,041 | 10/1982 | Bryans et al. . | |
| 4,375,052 | 2/1983 | Anderson . | |
| 4,410,866 | 10/1983 | Bui-Hai | 333/135 |
| 4,491,810 | 1/1985 | Saad | 333/126 |
| 4,504,805 | 3/1985 | Ekelman et al. . | |
| 4,853,657 | 7/1989 | Cruchon et al. . | |
| 4,912,436 | 3/1990 | Alford et al. . | |
| 4,920,351 | 4/1990 | Bartlett et al. . | |
| 4,999,591 | 3/1991 | Koslover et al. | 333/21 R |

OTHER PUBLICATIONS

Gamma-f Corp. Specification sheet for Cross-Polarization C-band Antenna Feed.

Gamma-f Corp. Specification Sheet for Co-Polarization C-band Antenna Feed.

Timothy Pratt et al. Satellite Communications; Published by John Wiley and Sons, 1986, cover page and pp. 326 and 327.

*Primary Examiner*—Michael C. Wimer

*Assistant Examiner*—Wael Fahmy

*Attorney, Agent, or Firm*—Bell, Seltzer, Park & Gibson

[57] ABSTRACT

An antenna feed having a common circular waveguide with a longitudinally extending rectangular slot in a wall thereof and defining a receive port. An iris is rotatably connected adjacent the receive port permitting selective relative polarization of the transmit and receive signals. The relative polarization may be readily selected by a technician in the field without the need for changing antenna feeds when, for example, changing from co-polarization to cross-polarization. The iris includes a rectangular opening therein permitting the passage therethrough of the transmit signal while blocking the passage of a signal of the same frequency as the receive signal. The iris is positioned adjacent the receive port to enhance coupling of the receive signal into the receive port. The antenna feed provides high isolation between transmit and receive ports without the need for a filter on the transmit port. The antenna feed may be used in a microwave communications link, such as an earth station to satellite communications link.

25 Claims, 3 Drawing Sheets

ANTENNA FEED WITH SELECTABLE RELATIVE POLARIZATION

FIELD OF THE INVENTION

This invention relates to an antenna feed for use with a satellite earth station and the like, and more particularly to an antenna feed having a selectable relative polarization between transmit and receive signals.

BACKGROUND OF THE INVENTION

Satellite communications systems typically include a number of earth stations with each station transmitting signals to and receiving signals from a satellite located in a geostationary orbit. The earth station typically employs a single antenna which serves the dual functions of radiating the transmit signal and capturing the receive signal. In a reflector antenna system, an antenna feed combines the transmit and receive signals which then are coupled to an antenna horn and directed to the reflector antenna.

The amount of electromagnetic spectrum available for earth station to satellite communications is limited. Multiple users are able to use different frequency channels in an assigned frequency band. For example, earth station C-Band users transmit in the band of 5.9–6.4 GHz and receive in the band of 3.7–4.2 GHz. However, as the number of satellite users has increased, additional measures have been used to further expand the use of satellite resources.

Frequencies can be reused, for example, if linear polarization separation is used to reduce unwanted interference from co-channel or adjacent channel sources. Many satellite earth stations operate either with "co-polarization", that is, both transmit and receive signals having the same relative polarization or using "cross-polarization", that is, transmit and receive polarizations are orthogonal relative to each other. Other relative angular orientations between the transmit and receive signals are also possible.

The antenna feed of an earth station typically couples the transmit signal to the antenna and couples the receive signal from the antenna to the receiver. Desirable characteristics of an antenna feed include high isolation between transmit and receive ports and low insertion loss. In addition, any feed should be relatively simple in construction to thereby allow for economical manufacture. Compact size and weight, and ruggedness are also desirable.

Microwave devices are known in the art for combining cross-polarized transmit signals. For example, U.S. Pat. No. 2,975,380 to Scharfman discloses a broadband waveguide transducer capable of coupling orthogonal modes from two sources. In addition, devices are known which combine co-polarized signals of different frequencies. For example, U.S. Pat. No. 4,504,805 to Ekelman et al. discloses a multi-port combiner having a common circular waveguide with fixed rectangular slots coupled to side arm waveguides for transmitting and receiving microwave co-polarized signals in at least two frequency bands.

Cross-polarization feeds are known in the art as are co-polarization feeds. However, each type of feed operates at only one configuration. Thus, one antenna feed is needed for co-polarized signals and an entirely different feed is required for cross-polarized signals. Therefore, to convert between co-polarization and cross-polarization, a technician must physically substitute the antenna feeds in the field. Moreover, applicant is unaware of any feed which may operate in either polarization configuration by simple field adjustment.

In addition, filters are typically required on all ports to provide adequate isolation between the transmit and receive ports. A filter, such as a cavity filter, adds to the cost of the feed and also increase insertion loss. For example, a four-port dual polarization frequency diplexer, including various types of filters, is shown in U.S. Pat. No. 4,912,436 to Alford et al.

SUMMARY OF THE INVENTION

It is therefore an object of the present invention to provide an antenna feed having a field selectable relative polarization between transmit and receive signals.

It is another object of the invention to provide an antenna feed having a high isolation between transmit and receive ports without the need for an additional filter at the transmit port.

It is a still another object of the invention to provide an antenna feed having a low insertion loss for both transmit and receive signals.

It is yet another object of the invention to provide an antenna feed which is simple in design, easily manufactured, and compact in size.

These and other objects according to the invention are provided by an antenna feed for coupling a transmit and a receive signal at selectable relative polarizations for use in a microwave communications link, such as an earth station to satellite link. The antenna feed includes a common waveguide having a rectangular slot extending longitudinally in a wall thereof. For operation with a transmit signal frequency higher than the receive signal frequency, the rectangular slot defines a side receive port having dimensions so that the receive signal may pass therethrough.

An iris is rotatably connected to the common waveguide at an end adjacent the receive port. The iris includes a rectangular opening defining a transmit through port for the antenna feed. The iris may be rotated with respect to the common waveguide thereby orienting the transmit port with respect to the receive port to select the relative polarization between the transmit and receive signals. The relative polarization may be selected to be co-polarized, cross-polarized, or any relative angular polarization. Moreover, the iris is preferably positioned adjacent the receive port to create a standing wave pattern with a peak amplitude adjacent the receive port to enhance coupling of the receive signal through the receive port. Low insertion loss is achieved for both the transmit and receive ports and high isolation is achieved between the transmit and receive ports without the need for a filter on the transmit port, such as a cavity filter.

The common waveguide of the antenna feed preferably comprises a circular waveguide having an inner diameter sufficient to support propagation of the transmit and receive signals. A cylindrical waveguide having a square cross-section may also be used; however, relative polarization will be limited to co-polarization and cross-polarization only.

The common waveguide of the antenna feed preferably includes a step transition therein to match the common waveguide and the transmit port to enhance coupling of the transmit signal through the common waveguide. The step transition may preferably be integrally formed in the common waveguide in a portion thereof intersecting the receive port. A tuning post may be positioned in the wall of the waveguide opposite the receive port to further enhance coupling of the transmit signal through the common waveguide when the feed is configured for cross-polarization operation.

The antenna feed preferably includes a series of longitudinally extending openings at the end adjacent the receive port. The iris includes a mating flange having a corresponding pattern of openings. Readily removable fasteners may be used to secure the iris flange to the common waveguide. The fasteners may be quickly disconnected by a technician to permit rotation of the iris to thereby adjust the relative polarization between transmit and receive signals in the field.

A rectangular waveguide may be connected to the common waveguide at the receive port. In addition, a plurality of tuning posts may be positioned in a wall of the rectangular waveguide to filter unwanted signals from the receiver. The rectangular waveguide may be secured to the common waveguide by dip brazing or other methods as would be readily understood by those skilled in the art.

A transmit waveguide may be secured to the iris opposite the common waveguide. The transmit waveguide may be a circular or rectangular waveguide with a series of tuning posts therein for matching to the transmit port. The transmit waveguide may include an N-type connector for coupling the transmit waveguide to a microwave transmitter via a coaxial cable.

The antenna feed may be used in a satellite earth station by coupling an earth station transmitter and receiver to the respective ports of the common waveguide. A flange may be also be included at end of the common waveguide opposite the iris. The common waveguide flange facilitates interconnection to a further waveguide, such as circular waveguide, for coupling the antenna feed to an antenna horn. The antenna horn is mounted in a position directed to a reflector antenna.

The antenna feed according to the present invention permits a field technician to change the relative polarization between transmit and receive signals by removing the fasteners, rotating the iris for the desired relative polarization, and reinstalling the fasteners. Although co-polarized and cross-polarized operation are most common, any relative angular orientation may be achieved. In addition, iris coupling of the transmit port eliminates the need for an additional filter, and positioning the iris adjacent the receive port enhances the signal coupling into the receive port.

DETAILED DESCRIPTION OF THE PREFERRED EMBODIMENT

The present invention will now be described more fully hereinafter with reference to the accompanying drawings, in which a preferred embodiment of the invention is shown. This invention may, however, be embodied in many different forms and should not be construed as limited to the embodiment set forth herein; rather, applicant provides this embodiment so that this disclosure will be thorough and complete, and will fully convey the scope of the invention to those skilled in the art. Like numbers refer to like elements throughout and prime notation is used to identify similar elements of alternate embodiments according to the present invention.

Figure 1:
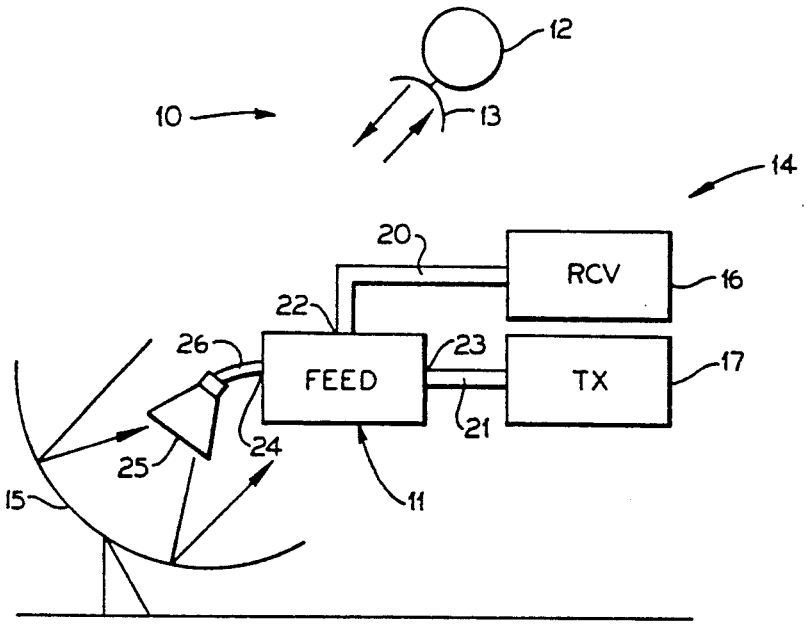
FIG. 1 is a schematic diagram showing an antenna feed in an satellite earth station installation according to the present invention.

Referring to FIG. 1, there is shown schematically a microwave satellite communications link 10 incorporating an antenna feed 11 according to present invention. The link 10 includes a satellite 12 in geostationary orbit having an antenna 13 to send and receive signals to and from an earth station 14. As would be readily understood by those having skill in the art, the antenna feed 11 may be used in other microwave communications links, such as point-to-point terrestrial links.

The earth station 14 includes a reflector antenna 15 for radiating the transmit signal and capturing the receive signal. For a C-Band earth station, the transmit frequency band, 5.9–6.4 GHz is higher than the receive frequency band, 3.7–4.2 GHz. The receiver 16 and the transmitter 17 are connected to the receive and transmit ports 22, 23 by receive and transmit waveguides 20, 21 respectively. The common port 24 of the antenna feed 11 is coupled to the antenna horn 25 by a waveguide 26, typically circular, capable of supporting propagation of both the transmit and receive signal frequencies.

Figure 2B:
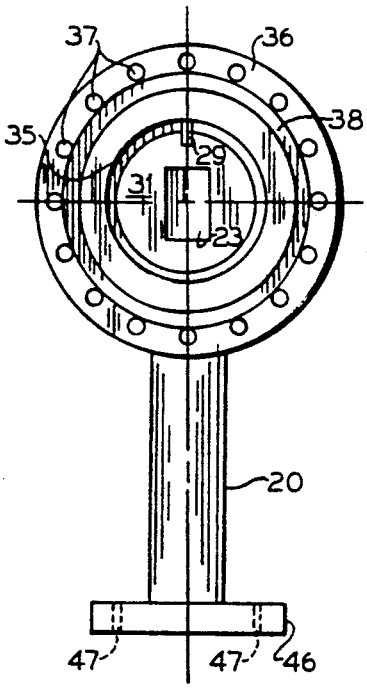
FIG. 2B is a front view into the common port of the antenna feed according to the present invention as shown in FIG. 2A.
Figure 2A:
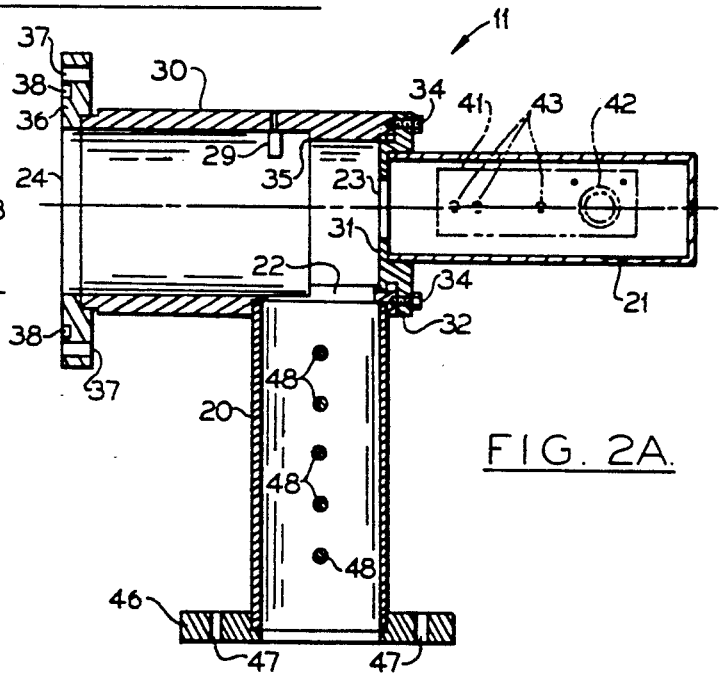
FIG. 2A is a side cross-sectional view of an antenna feed according to the present invention configured for co-polarization operation.
Figure 2C:
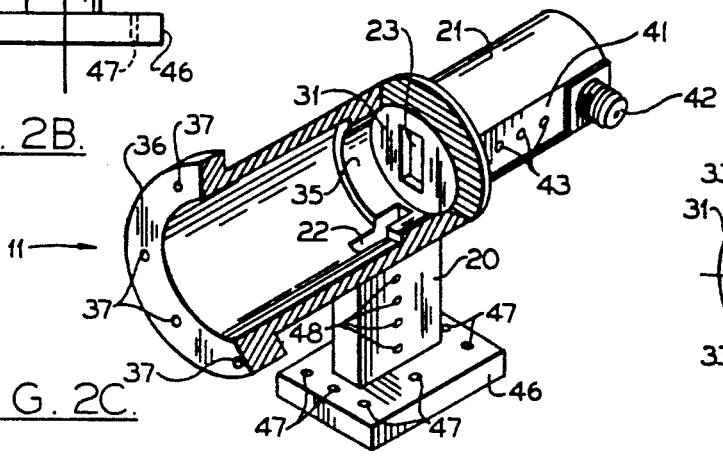
FIG. 2C is a cut-away side perspective view of the antenna feed of the present invention as shown in FIG. 2A.

Referring to FIGS. 2A–2C, the antenna feed 11 includes a common circular waveguide 30 having a longitudinally extending rectangular slot in a wall thereof defining a side receive port 22. For C-Band operation, the receive port 22 preferably has dimensions 1.55″×0.525″. The longer dimension, 1.55″, supports propagation through the receive port 22 and is related to the cutoff wavelength of the receive signal based on well known waveguide theory. Experimental results indicate the smaller dimension, 0.525″, provides better coupling of the receive signal into the receive port 22 than narrower slots as are sometimes used in other microwave coupling devices.

The common waveguide 30 is preferably a circular waveguide having interior dimensions sufficient to support propagation of both the transmit and receive signals therein according to well known waveguide theory relating to the cutoff wavelength of waveguides. For C-Band operation, a circular common waveguide 30 has a preferred inner diameter of 2.25". As an alternative, a waveguide having a square cylindrical shape may be used as the common waveguide. However, a square waveguide, not shown, will be limited to operating either in co-polarized or cross-polarized relative polarization. Moreover, the circular common waveguide 30 may be oriented to yield any angular relative polarization between the transmit and receive signals.

Figure 3:
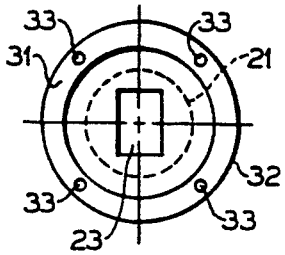
FIG. 3 is a plan view of an iris of the antenna feed according to the present invention.

An iris 31 (FIG. 3) is rotatably connected to the end of the common waveguide 30 at the end thereof adjacent the receive port 22. The positioning of the iris 31 adjacent the receive port 22 matches the common waveguide 30 to the receive port 22, that is, it creates a standing wave peak amplitude adjacent the receive port 22, to thereby further enhance coupling of the receive signal into the receive port 22.

The iris 31 includes a rectangular opening therein defining a transmit through port 23. The transmit port 23 has dimensions so that the transmit signal is permitted to pass therethrough but a signal having a frequency in the receive signal frequency band is blocked from passing. For C-Band operation, the transmit port 23 preferably has dimensions 0.6"×0.9". The iris 31 efficiently couples the transmit signal into the common waveguide 30 yet provides high isolation to the receive port 22. A cavity filter before the transmit port 23, as is typically employed to increase isolation to the receive port 22, need not be used.

As would be readily understood by those having skill in the art, the designation of receive port 30 for the side port and port 23 for the through port is based upon the receive signal having a lower frequency than the transmit signal, such as for C-Band operation. However, if the receive frequency signal were higher than the transmit signal, the through port would function as a receive port and the through port would function as a transmit port. For simplicity, the through port is referred to herein as the transmit port and the side port is referred to as the receive port. In addition, it would be readily understood by those having skill in the art that the specific dimensions given herein may be scaled according to the desired operating frequency so that the antenna feed 11 according to the present invention may be used in other microwave frequency bands as well.

The iris 31 preferably has a flange 32 formed integral therewith for interconnection to the common waveguide 30. The iris flange 32 has a pattern of openings 33 therein corresponding to the pattern of openings extending longitudinally into the common waveguide 30 at an end thereof adjacent the receive port 23. Readily removable fasteners 30, such as threaded screws, may be used to secure the iris flange 32 to the common waveguide 30. The rotational alignment of the iris 31 with respect to the common waveguide 30 selects the relative angular polarization of the transmit and receive signals. FIGS. 2A–2C illustrate the antenna feed 11 configured for co-polarization operation. However, a change from cross-polarization to co-polarization, or to any relative angular polarization, may quickly and easily be made in the field by a technician.

Figure 4:
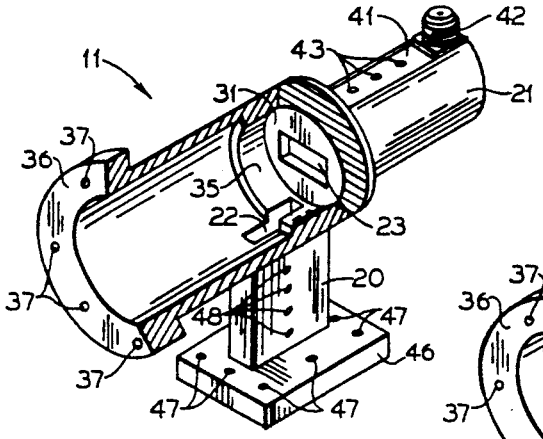
FIG. 4 is a cut-away front perspective view of an antenna feed according to the present invention configured for cross-polarization operation.
Figure 5:
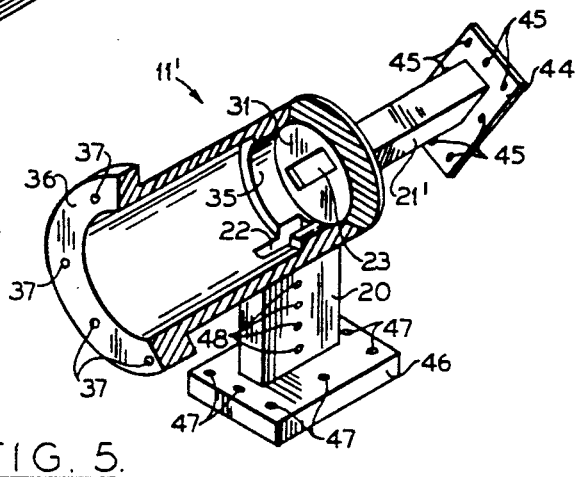
FIG. 5 is a cut-away front perspective view of an antenna feed according to the present invention configured for operation at 45° relative angular polarization.

Unlike prior art antenna feeds, which require a separate feed for co-polarization and cross-polarization, the antenna feed 11 according to the present invention may be used for any relative polarization by simple mechanical adjustment. FIG. 4 shows the antenna feed 11 configured for cross-polarization operation between the transmit and receive signals. The iris 31 is rotated so that the transmit port 23 has the longer dimension adjacent the receive port 22. Similarly FIG. 5 illustrates an antenna feed 11' configured for a 45° relative angular polarization between transmit and receive signals. As would be readily understood by one skilled in the art, the number of fasteners 34 and the pattern of openings 33 in the iris 31 may be increased to allow a greater number of relative angular polarizations. As would also be understood to those having skill in the art, a rotatable joint may be used in place of the removable fasteners 34 to then provide an infinite range of relative polarization angle.

The common waveguide 30 preferably includes a step transition 35 therein to match the transmit signal between the transmit port 23 and the common waveguide 30, thereby providing lower insertion loss for the transmit signal. The step transition 35 is preferably formed in a portion of the common waveguide 30 intersecting the receive port 22. For a common circular waveguide 30 operating at C-Band, the step transition 35 preferably has an inner diameter of 2.00". The common waveguide 30 may also include an adjustable tuning post 29 positioned in the wall of the common waveguide 30 opposite the receive port 22 to further enhance coupling of the transmit signal through the transmit port 23 and into the common waveguide 30 for cross-polarization operation of the feed 11. The operation of such tuning posts will be readily understood by those having skill in the art and is not described further.

The end of the common waveguide 30 opposite the receive port 22 defines a common port 24 for the antenna feed 11. This end of the common waveguide 30 preferably includes a flange 36 (FIG. 2B) connected thereto with a pattern of openings 37 therein for connection to an adjacent waveguide section 26 (FIG. 1). The flange 36 may include a channel 38 to receive a sealing O-ring, not shown.

The transmit port 23 may be coupled to a transmit waveguide 21 by connecting the transmit waveguide 23 to the iris 31 by dip brazing, for example. The transmit waveguide 21 is typically a circular waveguide with a flattened portion 41 to receive an N-type connector 42. The N-type connector 42 may receive a mating connector fixed to a coaxial cable, not shown, for coupling to the microwave transmitter 17 (FIG. 1). In addition several tuning posts 43 may be positioned through the flattened portion 41 of the transmit waveguide 21. An alternate embodiment 11', as shown in FIG. 5, includes a short rectangular waveguide 21' with a flange 44 having a pattern of openings 45 therein for connection to an adjacent waveguide, not shown.

The receive port 23 may be coupled to a length of receive waveguide 20. The receive waveguide 20 preferably includes a series of tuning posts 48 to filter unwanted frequencies from the receiver 16 (FIG. 1). The receive waveguide 20 is connected to the common waveguide 30 adjacent the receive port 23 by dip brazing, for example. The receive waveguide 20 preferably includes a flange 46 connected thereto and having a pattern of openings 47 therein for connection to an adjacent waveguide, not shown.

Figure 6A:
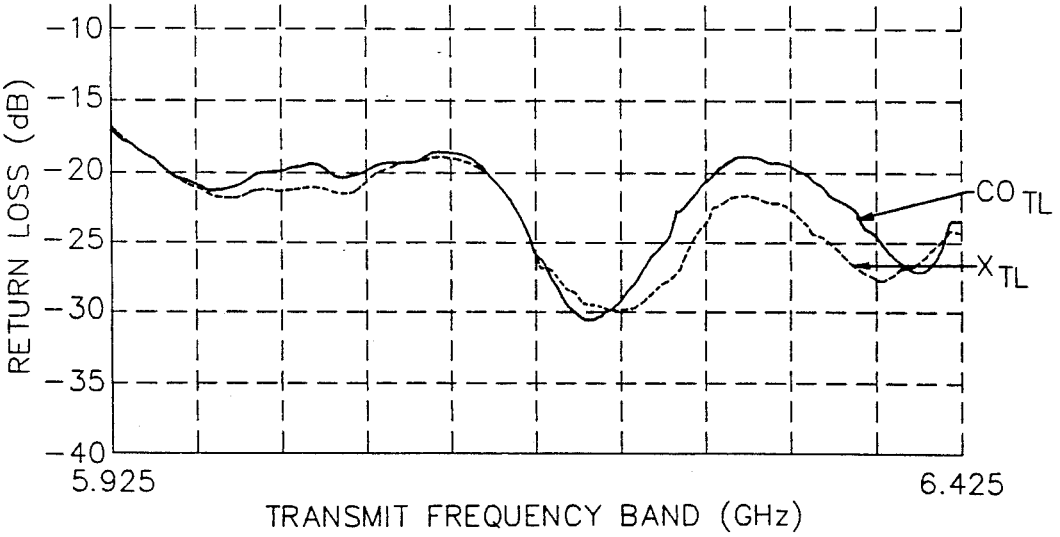
FIG. 6A is a graph of return loss versus frequency, over the C-Band transmit frequency range, for co-polarization and cross-polarization operation of an antenna feed according to the present invention.
Figure 6B:
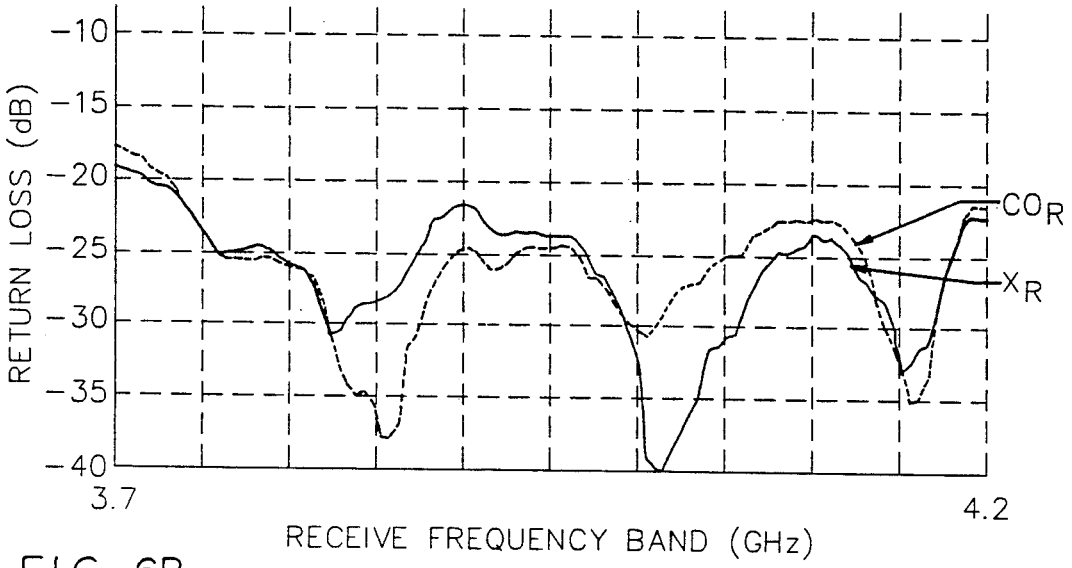
FIG. 6B is a graph of return loss versus frequency, over the C-Band receive frequency range, for co-polarization and cross-polarization operation of an antenna feed according to the present invention.

FIG. 6A illustrates measured plots of return loss, in decibels (dB), versus signal frequency, in GHz, for the antenna feed as shown in FIG. 2A operating in both the co-polarized $CO_{TL}$ and cross-polarized $X_{TL}$ configuration over the transmit frequency band range of 5.925–6.425 corresponding to C-Band. Similarly, FIG. 6B illustrates measured plots of return loss for the antenna feed 11 operating in the co-polarization $CO_{RL}$ and cross-polarization $X_{RL}$ configuration. The antenna feed 11 exhibits acceptable performance in both configurations and over both frequency bands.

Figure 7A:
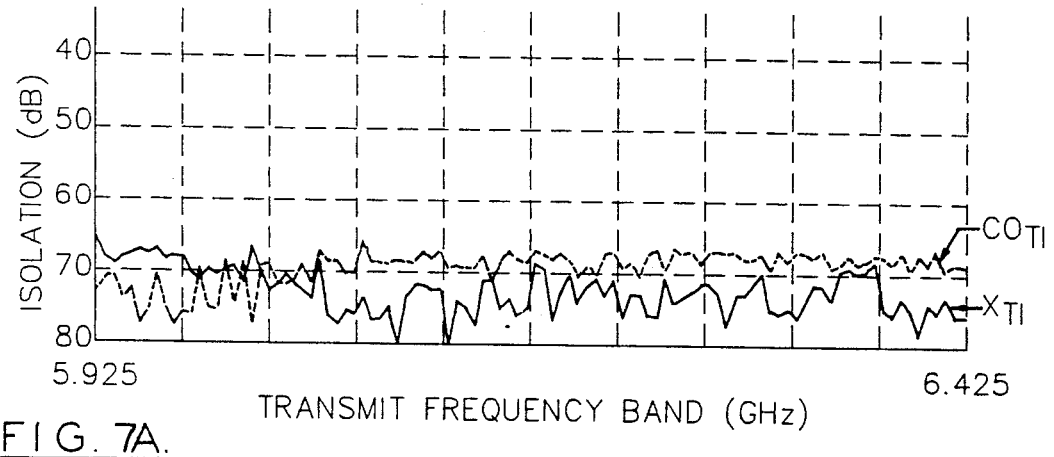
FIG. 7A is a graph of the isolation versus frequency, over the C-Band transmit frequency range, for co-polarization and cross-polarization operation of an antenna feed according to the present invention.
Figure 7B:
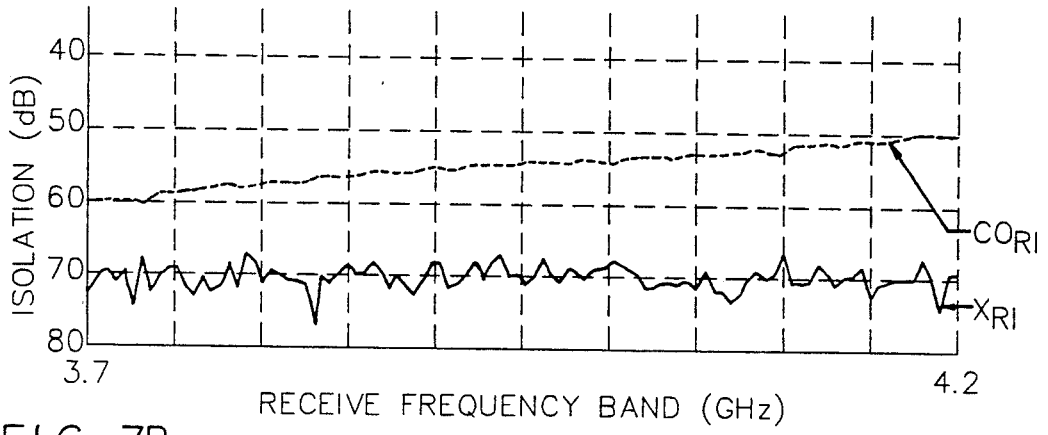
FIG. 7B is a graph of the isolation versus frequency, over the C-Band receive frequency range, for co-polarization and cross-polarization operation of an antenna feed according to the present invention.

FIGS. 7A and 7B illustrate plots of the isolation achieved between the transmit and receive ports. FIG. 7A shows plots of the isolation between transmit and receive ports in the transmit frequency band for co-polarized $CO_{TI}$ and cross-polarized $X_{TI}$ operation. FIG. 7B shows isolation of over the receive frequency band range for co-polarized $CO_{RI}$ and cross-polarized $X_{RI}$ operation. As can be determined from the plots, the minimum isolation is approximately 50 db for the co-polarized configuration at a frequency of about 4.2 GHz in the received frequency band. The isolation values meet or exceed commercially acceptable performance criteria.

Many modifications and other embodiments of the invention will come to one skilled in the art having the benefit of the teachings presented in the foregoing descriptions and the associated drawings. Therefore, it is to be understood that the invention is not to be limited to the specific embodiment disclosed, and that modifications and embodiments are intended to be included within the scope of the appended claims.

What is claimed is:

1. An antenna feed for coupling a first and second signal at selectable relative polarizations, said antenna feed comprising:

a common cylindrical waveguide having a longitudinal axis and having a rectangular slot extending longitudinally in a wall thereof and defining a side port, said rectangular slot having dimensions so that the second signal is permitted to pass therethrough;

an iris rotatably connected to said common waveguide transverse to the longitudinal axis of said common waveguide, said iris having a rectangular opening therein and defining a through port, said through port permitting passage therethrough of the first signal and blocking passage therethrough of the second signal; and a step transition integrally formed in said common cylindrical waveguide in a portion thereof intersecting said side port to match said common waveguide and said through port to enhance coupling of said first signal therebetween; and whereby selective rotation of said iris with respect to said common waveguide orients said through port with respect to said side port to thereby select a relative polarization between the first and second signals.

2. The antenna feed of claim 1 wherein said common waveguide comprises a circular waveguide having an inner diameter to support propagation therein of the first and second signals.

3. The antenna feed of claim 1 further comprising an adjustable tuning post positioned in a wall portion of said common waveguide opposite said side port to enhance coupling of the first signal between said common waveguide and said through port.

4. The antenna feed of claim 1 wherein said common waveguide includes a pattern of longitudinally extending openings at an end thereof adjacent said side port, wherein said iris includes a flange formed integral therewith, wherein said flange has a pattern of openings therethrough corresponding to said common waveguide pattern of openings, and wherein said antenna feed further comprises a plurality of readily removable fasteners extending through said iris flange openings and into said common waveguide openings.

5. The antenna feed of claim 1 wherein said antenna feed further comprises a flange connected to an end of said common waveguide opposite said iris so that said antenna feed is connectable to an adjacent waveguide section.

6. An antenna feed for coupling a first and second signal, the first signal having a higher frequency than the second signal, said antenna feed comprising:

a common cylindrical waveguide having a longitudinal axis and having inner dimensions to support propagation therein of the first and second signals, said common waveguide having a rectangular slot extending longitudinally in a wall thereof and defining a side port, said rectangular slot having dimensions so that the second signal is permitted to pass therethrough;

an iris connected to said common waveguide transverse to the longitudinal axis of said common waveguide, said iris having a rectangular opening therein and defining a through port, said through port permitting passage therethrough of the first signal and blocking passage therethrough of the second signal;

said iris positioned at an end of said common waveguide adjacent said side port to match common waveguide and said side port to enhance coupling of the second signal therebetween; and a step transition integrally formed in said common cylindrical waveguide in a portion thereof intersecting said side port to match said common waveguide and said through port to enhance coupling of said first signal therebetween;

whereby low insertion loss is achieved for both said side and through ports and whereby high isolation is achieved between said side and through ports.

7. The antenna feed of claim 6 wherein said common waveguide comprises a circular waveguide.

8. The antenna feed of claim 6 further comprising an adjustable tuning post in a wall portion of said common waveguide opposite said side port to enhance coupling of the first signal between said common waveguide and said through port.

9. The antenna feed of claim 6 wherein said common waveguide includes a pattern of longitudinally extending openings at an end thereof adjacent said side port, wherein said iris includes a flange formed integral therewith, wherein said flange has a pattern of openings therethrough corresponding to said common waveguide pattern of openings, and wherein said antenna feed further comprises a plurality of fasteners extending through said iris flange openings and into said common waveguide openings.

10. The antenna feed of claim 6 wherein said antenna feed further comprises a flange connected to an end of said common waveguide opposite said iris so that said antenna feed is connectable to an adjacent waveguide section.

11. An antenna feed for coupling a transmit signal and a receive signal at a selectable relative polarization, the transmit signal having a higher frequency than the receive signal, said antenna feed comprising:

a common circular waveguide having a longitudinal axis and an inner diameter to support propagation therein of the transmit and receive signals, said common waveguide having a rectangular slot longitudinally extending in a wall thereof and defining a receive port, said rectangular slot having dimensions so that the receive signal is permitted to pass therethrough;

an iris rotatably connected to said common waveguide transverse to the longitudinal axis of said common waveguide at an end thereof adjacent said receive port to enhance coupling of the receive signal through said receive port, said iris having a rectangular opening therein permitting passage therethrough of the transmit signal and blocking passage therethrough of a signal having a frequency of the receive signal, said rectangular opening of said iris defining a transmit port; and a step transition integrally formed in said common circular waveguide in a portion thereof intersecting said receive port to enhance coupling of said receive signal through said common waveguide;

whereby selective rotation of said iris with respect to said common waveguide orients said transmit port with respect to said receive port to thereby select a relative polarization between the transmit and receive signals.

12. The antenna feed of claim 11 further comprising an adjustable tuning post in a wall portion of said common waveguide opposite said receive port to enhance coupling of the transmit signal into said common waveguide.

13. The antenna feed of claim 11 wherein said common waveguide includes a pattern of longitudinally extending openings at an end thereof adjacent said iris, wherein said iris includes a flange formed integral therewith, wherein said flange includes a pattern of openings therethrough corresponding to said common waveguide pattern of openings, and wherein said antenna feed further comprises a plurality of readily removable fasteners extending through said iris flange openings and into said common waveguide openings.

14. The antenna feed of claim 11 wherein said antenna feed further comprises a flange connected to an end of said common waveguide opposite said iris so that said antenna feed is connectable to an adjacent waveguide section.

15. A communications apparatus for use as a satellite earth station, said apparatus comprising:

a transmitter for transmitting a signal in a transmit frequency band;

a receiver for receiving a signal in a receive frequency band lower in frequency than said transmit frequency band;

an antenna for radiating said transmit signal and capturing said receive signal;

a common cylindrical waveguide having a longitudinal axis and having a first end defining a common port;

means connected to said common port for coupling said transmit and receive signals to said antenna;

said common waveguide including a rectangular slot extending longitudinally in a wall thereof adjacent a second end thereof opposite said first end and defining a receive port;

a receive waveguide for coupling said receiver to said receive port;

an iris rotatably connected to said second end of said common waveguide, transverse to the longitudinal axis of said common waveguide, said iris having a rectangular opening therein permitting passage therethrough of the transmit signal and blocking passage therethrough of a signal having a frequency of the receive signal, said rectangular opening of said iris defining a transmit port;

a step transition integrally formed in said common cylindrical waveguide in a portion thereof intersecting said receive port to enhance coupling of said receive signal through said common waveguide; and a transmit waveguide for coupling said transmitter to said transmit port;

whereby the relative polarization of said transmit and receive signals is selectable by rotation of said iris with respect to said common waveguide.

16. The apparatus of claim 15 wherein said iris is positioned adjacent said receive port to enhance coupling of the receive signal into said receive port.

17. The apparatus of claim 15 wherein said common waveguide comprises a circular waveguide having an inner diameter to support propagation therein of said transmit and receive signals.

18. The antenna feed of claim 15 wherein said transmit waveguide is a rectangular waveguide having dimensions to support propagation therein of said transmit signal and block propagation therein of a signal having a frequency of said receive signal.

19. The antenna feed of claim 15 wherein said transmit waveguide is a circular waveguide having dimensions to support propagation therein of said transmit signal and block propagation therein of a signal having a frequency of said receive signal.

20. The apparatus of claim 19 wherein said transmit waveguide includes tuning means positioned therein for enhancing coupling of said transmit signal through said transmit port.

21. The apparatus of claim 15 wherein said receive waveguide includes tuning means positioned therein for filtering an undesired signal.

22. The apparatus of claim 15 wherein said means for coupling said antenna to said common port comprises a circular waveguide connected to an antenna horn.

23. A method of selecting a desired relative polarization between a first and second signal, said method comprising the steps of:

providing a common waveguide having a longitudinal axis and having a longitudinally extending slot in a wall thereof permitting passage therethrough of the second signal, the common waveguide having an iris rotatably connected to an end thereof adjacent the longitudinal slot and transverse to the longitudinal axis of the common waveguide, the iris having a rectangular opening therein permitting passage therethrough of the first signal and blocking passage therethrough of the second signal, the common waveguide including a step transition integrally formed in a portion of the common waveguide intersecting the longitudinally extending slot, and rotationally orienting the iris with respect to the common waveguide to a desired angle to thereby select the desired relative polarization between the first and second signals.

24. The method of claim 23 wherein the first signal comprises a transmit signal and the second signal comprises a receive signal.

25. The method of claim 24 wherein the step of providing a common waveguide further comprises the step of providing the common waveguide secured to the iris by readily removable fastener means, and wherein the step of rotationally orienting the iris with respect to the common waveguide comprises the steps of:

removing the readily removable fastener means securing the iris to the common waveguide;

rotating the iris to the desired angle; and refastening the fastener means to secure the iris to the common waveguide at the desired angle to thereby select the desired relative polarization angle between the first and second signals.

* * * * *